US005431471A

United States Patent [19]

Baumann

[11] Patent Number: 5,431,471

[45] Date of Patent: Jul. 11, 1995

[54] SIDE FITTING CONNECTION APPARATUS FOR LIFTING TRAILERS AND CONTAINERS

[75] Inventor: James A. Baumann, Orland Park, Ill.

[73] Assignee: Mi-Jack Products, Inc., Hazel Crest, Ill.

[21] Appl. No.: 945,747

[22] Filed: Sep. 16, 1992

[51] Int. Cl.[6] ..... B66C 1/66

[52] U.S. Cl. ..... 294/68.3; 294/81.54; 294/907; 414/460

[58] Field of Search ..... 294/67.3, 67.31, 67.33, 294/68.1, 68.3, 81.1, 81.2, 81.21, 81.51, 81.54, 81.6, 81.62, 119.1, 907; 414/459, 460, 560, 607

[56] References Cited

U.S. PATENT DOCUMENTS

| | | | |
|---|---|---|---|
| 1,860,733 | 5/1932 | Fitch . | |
| 3,262,729 | 7/1966 | Willison et al. | 294/81.51 X |
| 3,567,266 | 3/1971 | Bridge | 294/68.3 |
| 4,139,107 | 2/1979 | Ninomiya et al. | 214/40 |
| 4,563,031 | 1/1986 | Kishimoto et al. | 294/81.51 X |
| 4,583,902 | 4/1986 | Riley | 294/86.41 X |
| 4,693,017 | 9/1987 | Oehler et al. | 294/68.3 X |
| 4,946,068 | 8/1990 | Erikson et al. | 294/81.2 X |

*Primary Examiner*—Dean J. Kramer
*Attorney, Agent, or Firm*—Robert A. Brown

[57] ABSTRACT

An apparatus for lifting truck trailers and cargo containers is provided and includes a plurality of latch arm assemblies. A side fitting connection device is secured at four predetermined locations on external upper side locations of a trailer or a container. Each interlocking latch arm assembly includes a complementary shaped projection member adaptable to engage with and be secured to each side fitting device. The side fitting connection device and latch arm assembly, when connected and engaged together, permit top side lifting of trailers and containers for intermodal movement thereof. The external upper side locations of the side fitting device permit full, complete and more profitable usage of the internal space or volume of truck trailers or cargo containers.

13 Claims, 7 Drawing Sheets

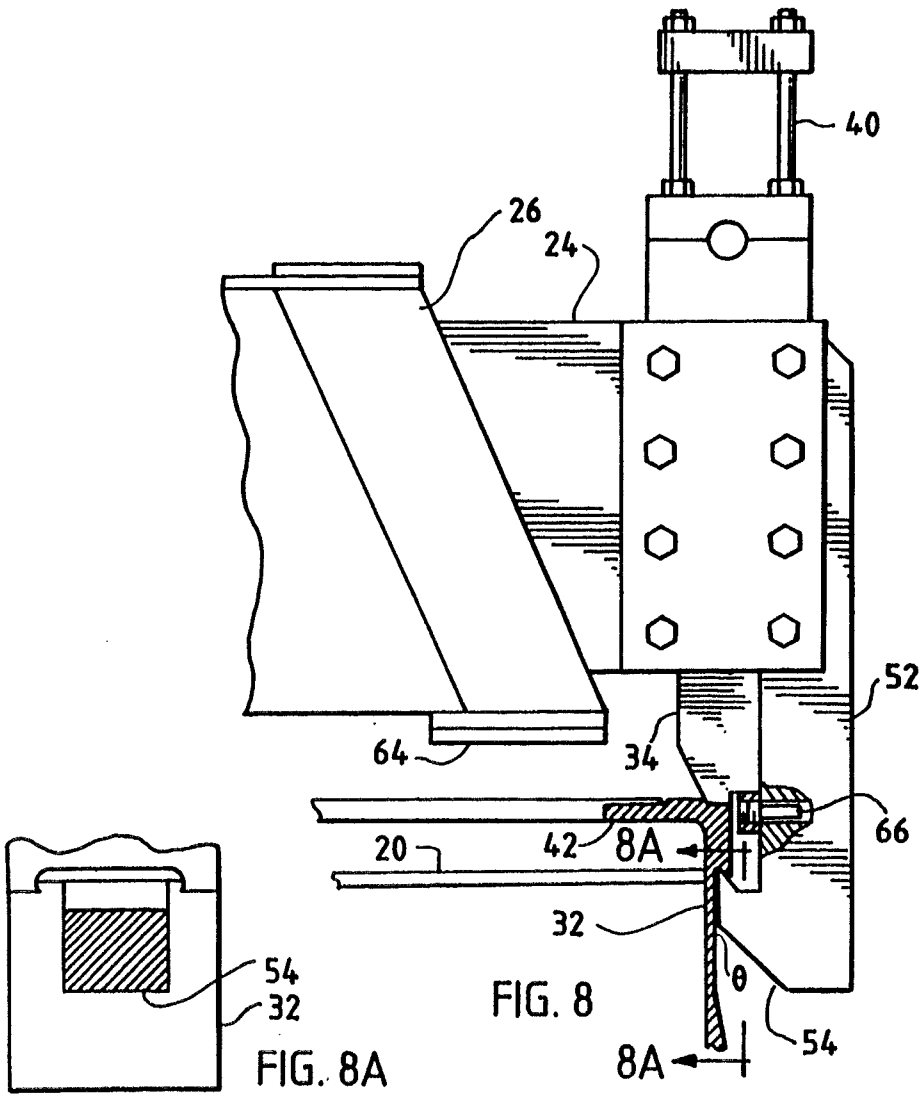
FIG. 8
FIG. 8A
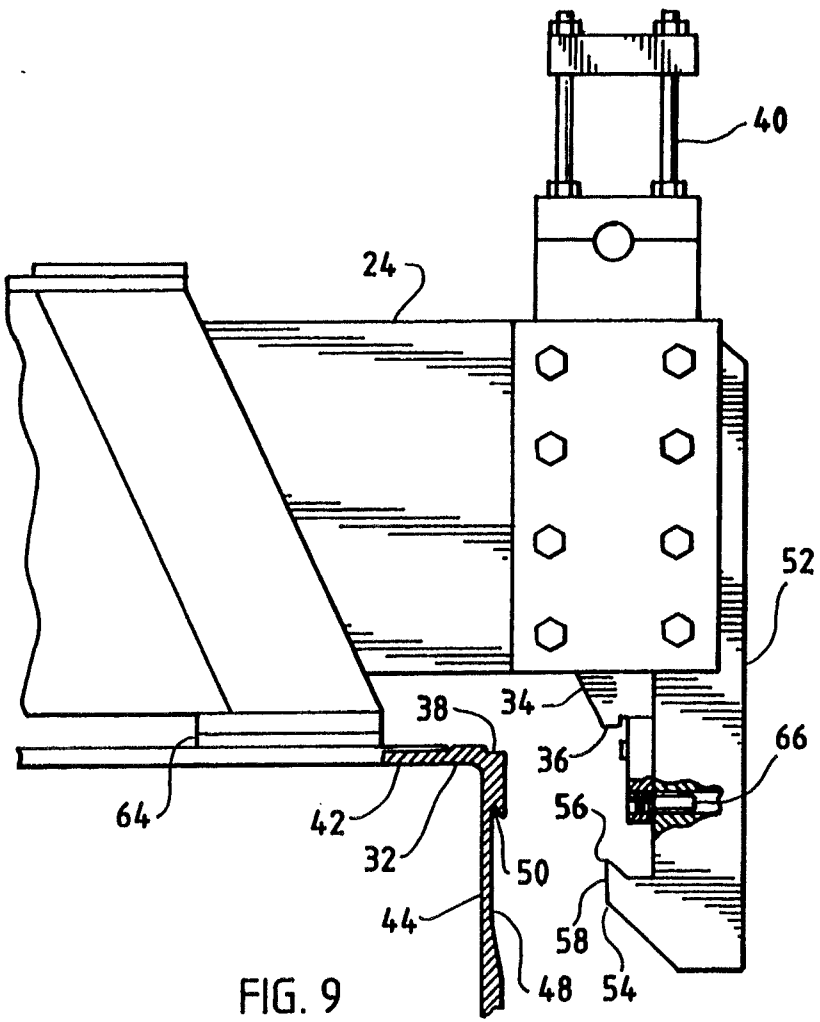
FIG. 9

SIDE FITTING CONNECTION APPARATUS FOR LIFTING TRAILERS AND CONTAINERS

BACKGROUND OF THE INVENTION

The present invention relates generally to the handling of truck trailers or transport containers and more particularly to an apparatus and method for attaching a side fitting connection device to an upper side surface of a truck trailer or a cargo container so as to facilitate lifting thereof. The side fitting connection device includes a casting or other suitably constructed member secured to and disposed at a predetermined external location on the trailer or container and an interlocking, complementary shaped member is provided to be fixedly received by each side fitting connection device.

DESCRIPTION OF THE PRIOR ART

The transportation industry requires and uses a number of different types of tractor-trailer rigs for over-the-road movement of goods and products in interstate commerce. In addition, goods and products are shipped from one place to another in cargo containers mounted on railroad freight cars. Also, these containers may be transferred from freight cars into holds of ocean going vessels for transportation of goods and products to overseas destinations. In order to handle a diverse array of goods and products at a minimum cost and greatest economic benefit in shipment from one section of the country to another, or overseas, it is necessary to transfer truck trailers and/or containers intermodally, or from road to rail car, or vice versa.

Generally, in the past, it was customary to drape and attach a grappling hook apparatus over and about a truck trailer in order to lift it from a roadway and place it on a railroad freight car, a loading system known as Trailer On Freight Car (TOFC). A similar procedure has been used to transfer a cargo container from a railroad siding storage area or from a ship's hold to a railroad freight car, this system being known as Container On Freight Car (COFC). It has also been possible to use an apparatus having bottom side connection fittings that attach to receiving receptacles disposed on the top side of a trailer or container that uses pins, hooks, twist lock devices, and the like, in order to connect a lifting apparatus to a trailer and transport it to or from a railroad flat car. The need to attach grapple hooks to a bottom side of a trailer is inefficient and time consuming. Furthermore, the receiving receptacles or top side fittings disposed on a trailer or container require inwardly projecting protuberances that reduce significantly the inside storage space or volume available for packing and transporting merchantable goods and products. Thus, a potential "pay load" is greatly reduced and adversely affects the bottom line profit that can be realized in the movement of goods from one location to another.

Accordingly, locating upper side fittings on an outside surface or externally of a trailer or a container would serve a dual purpose; first, the advantage of permitting more efficient handling of a trailer from above, especially when stacking a trailer on top of a container disposed on a railroad freight car, or stacking one container on top of another; and second, the distinct extra profit realized by taking advantage of all of the available internal volume or storage area of a trailer or container for loading and transporting therein a maximum amount of goods and products. Thus, the present invention eliminates any intrusion or inward projections within the inside storage space of a trailer or container and thereby "frees up" or makes available increased cargo space within the trailer or container that can be translated into additional revenue and higher profits.

SUMMARY OF THE INVENTION

Therefore, it is a primary object of the present invention to provide a lifting apparatus that includes a side fitting device means attached to a predetermined position at an upper side location on a trailer or a container and an interlocking securing means supported by the lifting apparatus and adaptable to be fixedly received by each of the side fitting device means.

It is a further object of the present invention to provide a side fitting means and an interlocking securing means adaptable to lift a truck trailer or cargo container from an external location thereon.

An additional object of the present invention is to provide a side fitting means adaptable to be secured to an external upper side location on a tractor trailer or cargo container for lifting thereof while maintaining therein an unobstructed and completely usable internal volume of space.

Another object of the present invention is to provide a side fitting means adaptable to be secured to an upper side location on a truck trailer having a thin walled, lightweight skin structure without incurring deformation thereof.

A still further object of the present invention is to provide a side fitting means adaptable to be secured to an upper side location on a truck trailer for lifting the same while maintaining the structural design integrity thereof.

An additional object of the present invention is to provide a plurality of side fitting means secured to a truck trailer for receiving a plurality of complementary shaped interlocking means attached to a lifting apparatus whereby the truck trailer may be positioned in a locking arrangement with a cargo container deposed on a railroad freight car.

A still further object of the present invention is to provide a side fitting means and interlocking securing means for maintaining at an upper side location on a truck trailer vertical and horizontal force vectors so as to maintain a vise-like grip between the side fitting means, the interlocking means and the truck trailer.

A still further object of the present invention is to provide a novel truck trailer or cargo container having a side fitting means secured to an upper external location on the truck trailer or cargo container which permits engagement with an interlocking securing means on a lifting apparatus for lifting the truck trailer or cargo container to move the same from one location to another.

These and other objects are achieved in accordance with the present invention wherein there is provided an improved side fitting connection apparatus for lifting a cargo container including gantry crane apparatus supporting grappling means for raising and lowering the cargo container from one location to another comprising side fitting means mounted to an upper side location on an external surface of the cargo container, said side fitting means including a linear notch means therein and an upper surface thereon, stabilizing beam means secured to and depending from said grappling means for supporting a plurality of latch box assembly means for attachment to said cargo container, each of said latch box assembly means comprising extendible arm means for horizontal movement outwardly beyond the overall width of said cargo container and movable vertically downwardly along an external wall of the cargo container, sensor pad means for making contact with said upper surface of said side fitting means for stopping downward movement of said extendible arm means, means for horizontal inward retraction of said extendible arm means, means for stopping said inward retraction of the extendible arm means adjacent said side fitting means, and means for moving said extendible arm means vertically to engage said extendible arm means with said liner notch means on said side fittings means to lift the cargo container.

The above and additional objects are achieved in accordance with the present invention wherein there is provided an improved cargo container comprising a plurality of side fitting means mounted at predetermined upper side locations on said container and spaced apart so as to provide predetermined span lengths therebetween, each said side fitting means comprising body means having an upper horizontal flange member installed substantially coincident with the roof line of said container, a vertical flange member extending downwardly from said horizontal flange member and secured externally of said vertical side surface of said container, said horizontal flange member and said vertical flange member being connected by an upper section member, and said upper section member having formed therein an upwardly projecting linear notch section.

BRIEF DESCRIPTION OF THE DRAWING

The foregoing and other characteristics, objects, features and advantages of the present invention will become more apparent upon consideration of the following detailed description, having reference to the accompanying figures of the drawing, wherein:

FIG. 8 is an enlarged front elevational view taken along lines 8—8 of FIG. 7 wherein are shown in partial section details of the side latch connection fitting engaged with a rotatable arm of the side latch connecting assembly of the present invention;

FIG. 8A is a side elevational sectioned view taken along lines A—A of FIG. 8 showing the elongate linear point to point contact between the notch means of the side fitting member and the upper end of the hook of the arm of the side latch assembly when the apparatus is engaged in a lifting mode in accordance with the present invention;

FIG. 9 is an enlarged front elevational view of the arrangement shown in FIG. 8, wherein the side latch connection fitting and the rotatable arm of the side latch connecting assembly are depicted in a disengaged position;

DESCRIPTION OF A PREFERRED EMBODIMENT

Figure 1:
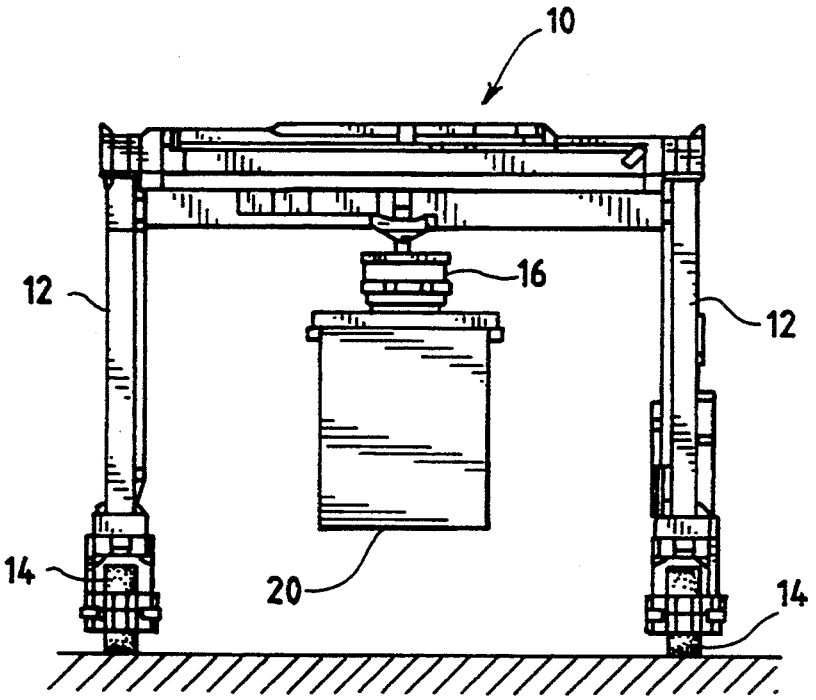
FIG. 1 is a front elevational view of a crane apparatus including a carrier assembly depending therefrom whereon is disposed a latching mechanism adaptable to mate with and be securely affixed to a side fitting casting attached to an upper side surface at four predetermined locations on a truck trailer or a cargo container in accordance with the present invention.
Figure 2:
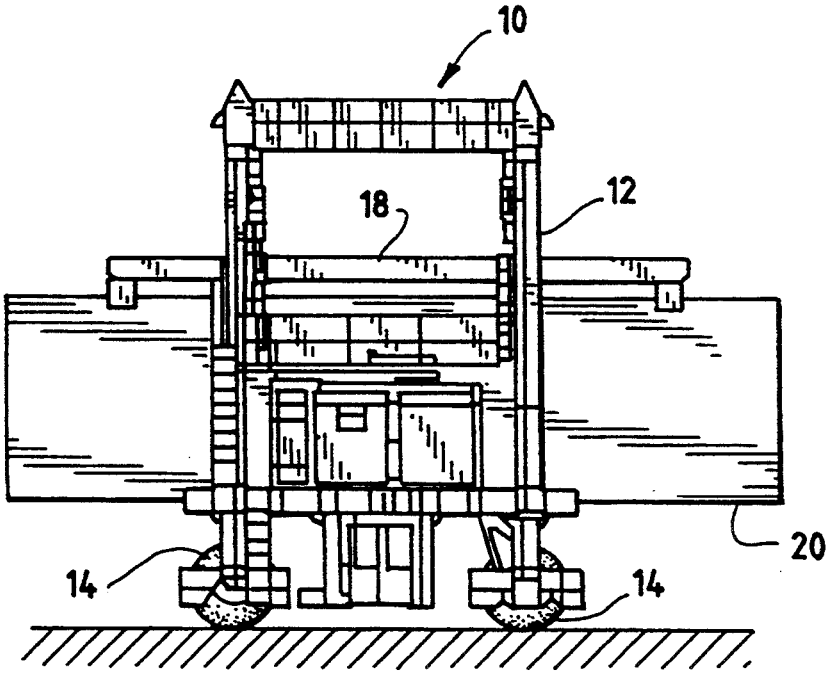
FIG. 2 is a side elevational view of the crane apparatus shown in FIG. 1.

Referring now to FIGS. 1–5, there is shown a gantry crane and lifting apparatus, generally indicated by reference numeral 10, capable of directed movement along ground level and adaptable for lifting and transporting one or more of a stack of truck trailers or cargo containers used in intermodal roadway shipping and railroad freight car transportation applications. The apparatus 10 includes a plurality of portal frame assemblies constructed to include horizontal beams or girders, as is known in the prior art. The lower portion of each portal frame includes a pair of upright corner columns 12 supported by two pivotally attached wheel assemblies 14, suitably powered by drive means (not shown) for moving the crane along ground level. The portal assemblies are connected fore and aft by the beams and support therein a grapple mechanism 16 depending from a stabilizing beam 18 that is operable to move upwardly and downwardly so as to position the grapple mechanism for attachment to a working load, such as a trailer or container 20. The apparatus thus described is effective to move along and span a transportation container workplace, a plurality of roadways, railroad tracks, and the like, so as to enable intermodal transfer of trailers and containers from flat bed trucks to railroad freight cars and vice versa.

Figure 3:
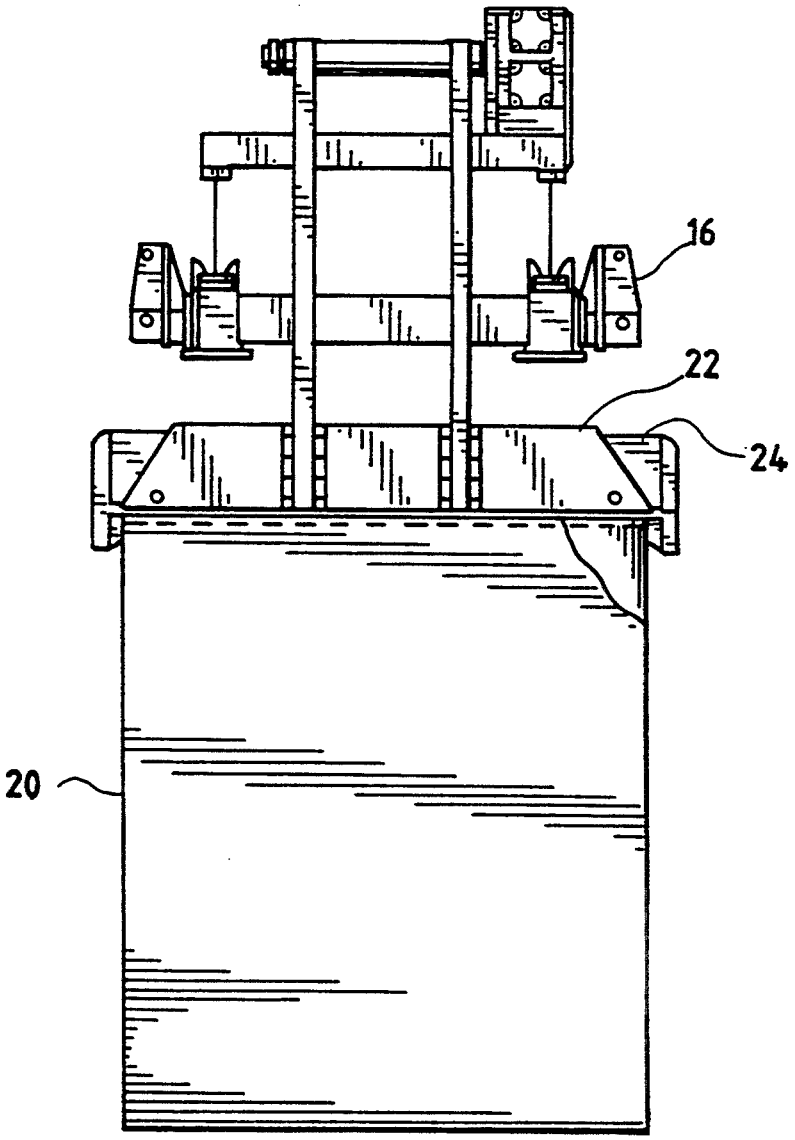
FIG. 3 is a front elevational view of a portion of the carrier assembly showing a bottom transverse member overlapping a top portion or roof of the trailer or container fixedly connected to the side fitting connection castings anchored to the container in accordance with the present invention.
Figures 4, 5:
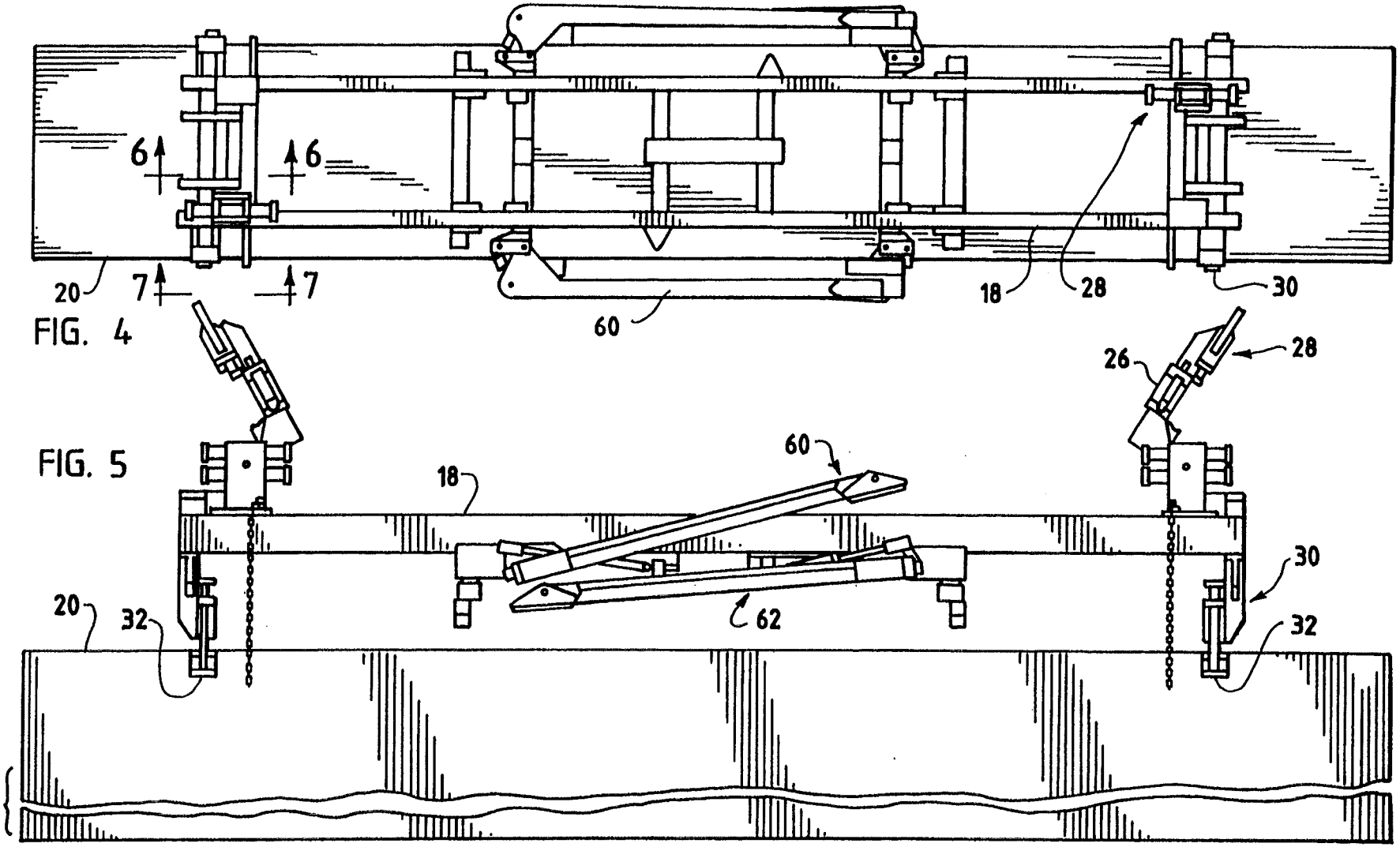
FIG. 4 is a top plan view of the carrier assembly showing its attachment to the container at four locations adjacent to but somewhat inboard from the two ends of the container in accordance with the present invention.
FIG. 5 is a side elevational view of the carrier assembly and its attachment arrangement to a container in accordance with the present invention.
Figure 6:
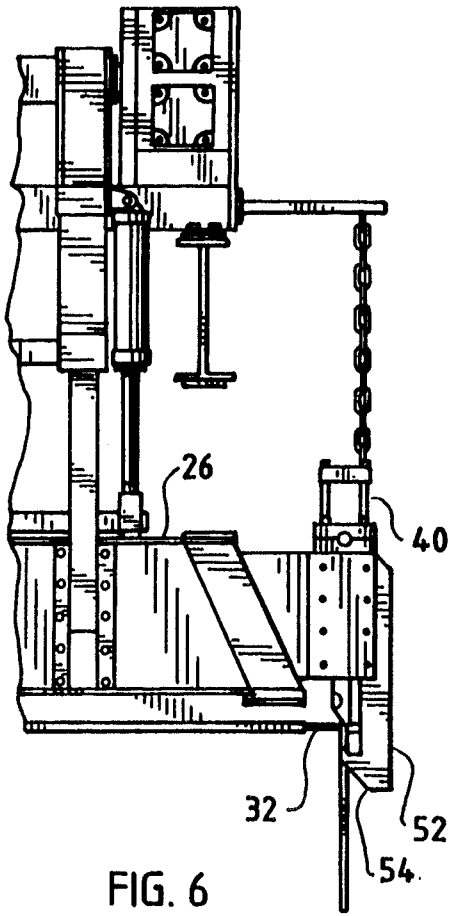
FIG. 6 is a front elevational view taken along lines 6—6 of FIG. 4 wherein are shown in partial section details of the side latch assembly engaged with the side latch connecting means of the present invention.
Figure 7:
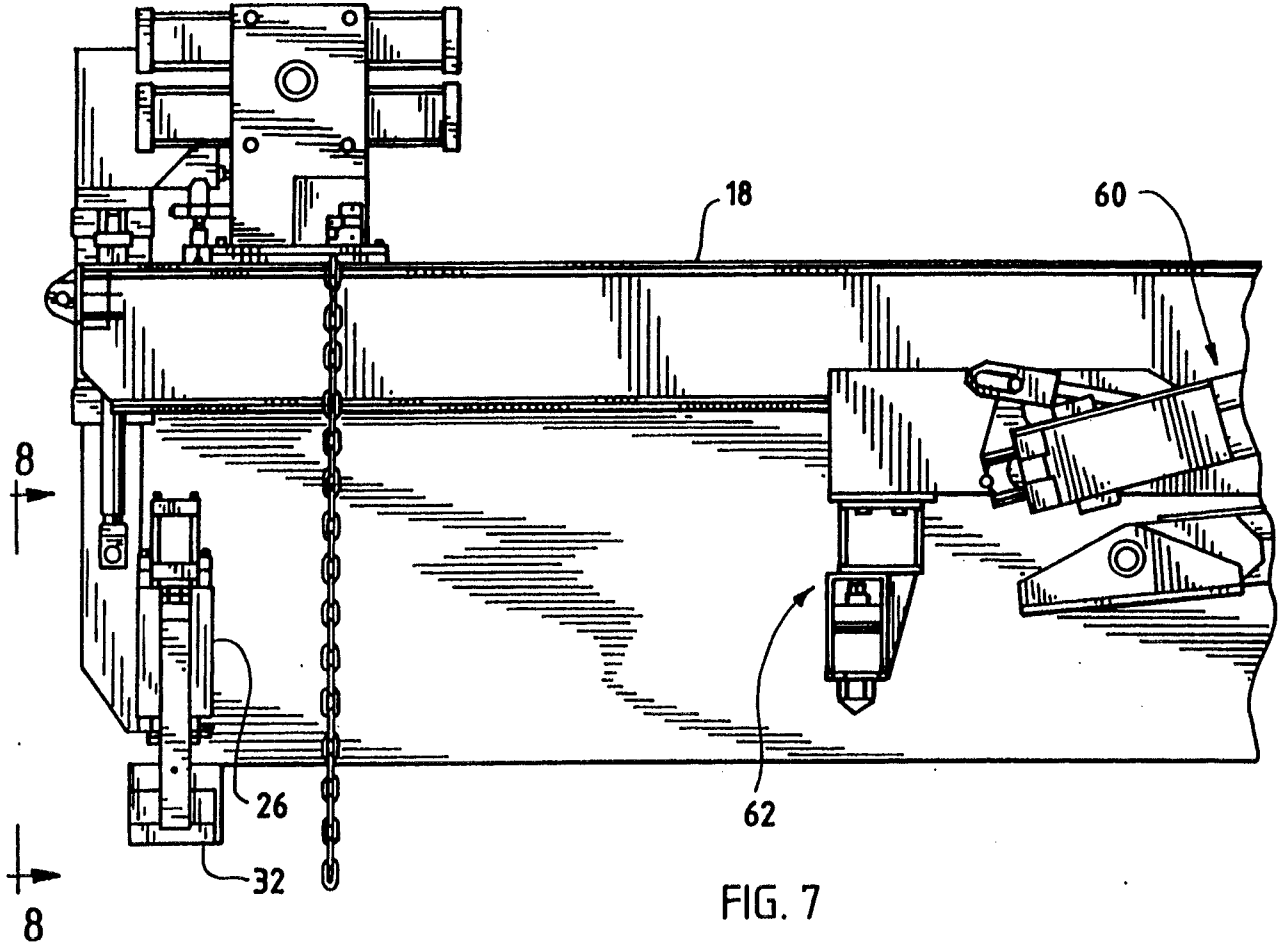
FIG. 7 is a side elevational view taken along lines 7—7 of FIG. 4 wherein the side latch connecting means is shown engaged with the side latch assembly that depends from and is supported by the stabilizing beam of the grapple mechanism.
Figure 10:
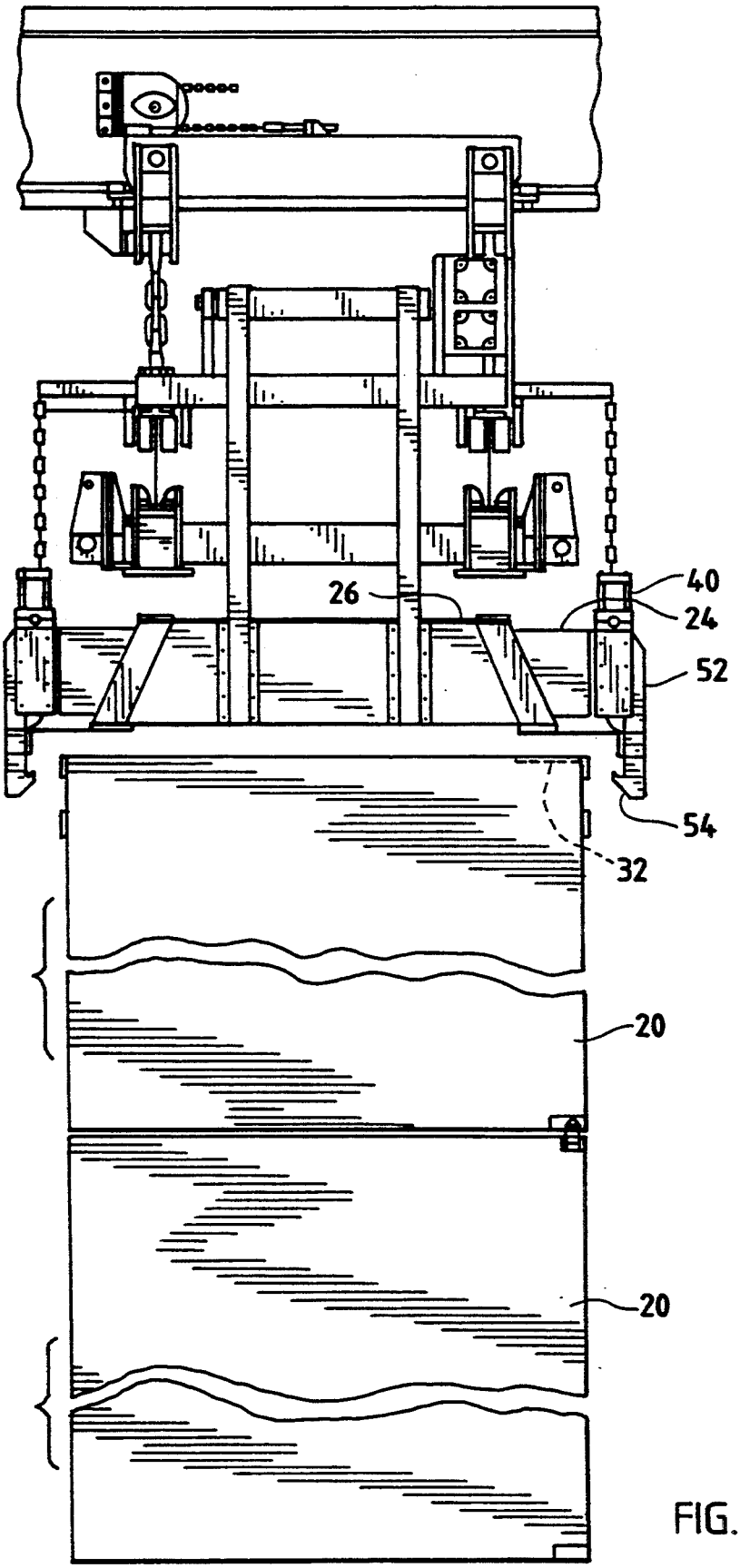
FIG. 10 is a partial front elevational view of the carrier assembly showing the side latch connecting assembly depending therefrom and disposed over and in position to connect with the side fittings located at upper sides of a trailer or container that is secured in a known manner to a lower trailer or container anchored to a railroad freight car in accordance with the present invention.
Figure 11:
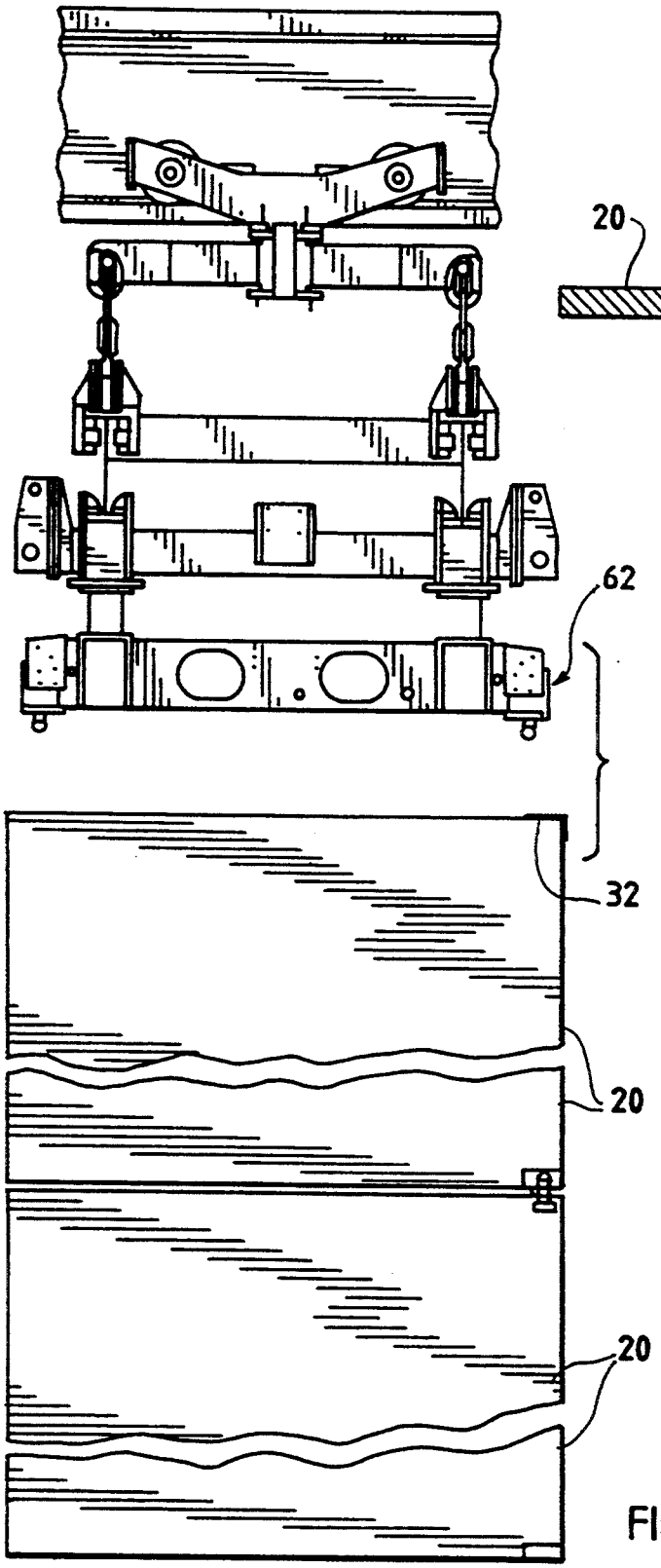
FIG. 11 is a partial front elevational view of the carrier assembly showing a conventional twist lock connecting assembly depending therefrom positioned over and for lowering into engagement with a trailer or container that is secured in a known manner to a lower trailer or container anchored to a railroad freight car.
Figure 12:
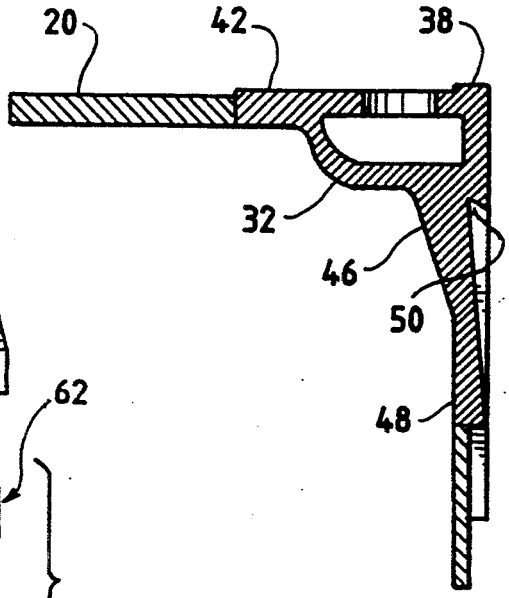
FIG. 12 is a front elevational, sectioned view of the side fitting connecting means of the present invention similar to that shown in FIG. 8, but directed to an alternate embodiment in accordance with the present invention.

Now referring to FIG. 3, the grapple mechanism 16 supports therebelow at least two transverse latch box assemblies 22 for positioning and placement above the roof or on top of the container at predetermined locations thereon. Each latch box assembly 22 includes at each distal end a telescopic or extendible arm 24 member or means for movement outwardly beyond the width of the trailer 20. Each arm 24 has mounted thereon a rotatable side latch assembly or means 26 for movement from a stowed position, as indicated generally by reference numeral 28, to a service position engaged with the container, as indicated generally by reference numeral 30 (FIG.5).

Next referring to FIGS. 8–9, the side latch assembly or means 26 is shown respectively in an engaged and a disengaged position with a side fitting connection member 32 which is suitably secured and anchored to a preselected upper side location of and on the container 20. The side latch assembly comprises a vise bar 34 having a lower end 36 for engagement with a top side surface 38 of the side fitting member or means 32 for a purpose to be hereinafter explained in greater detail. The vise bar 34 is operable upwardly and downwardly by a vise cylinder 40 so as to apply a vector of a predetermined desired amount of vertical force against the top side surface 38 of side fitting 32.

Each side fitting member 32, best shown in section in FIGS. 8–9, comprises an upper horizontal flange portion 42 that is installed in any desired location along the top side of the container 20 preferably coincident with the roof line thereof. The fitting member 32 includes also a vertical flange portion 44 that extends downwardly along an external upper side surface wall or skin of the container. The vertical flange portion 44 comprises a reinforced, upper section 46 and a lower section 48 connected by an upwardly projecting notch section or means 50 terminating in an upper, inner elongate intersection of plane surfaces forming an apex that is substantially parallel to the roof line of the container.

The side latch assembly 26 includes a vertically movable arm 52 that may be moved upwardly into engagement with the member 32 and has formed at its lower end an upwardly projecting hook member or means 54 that is shaped to have an outer end portion 56 to be substantially complementary to the upper, internal elongate apex surface configuration of notch section or means 50 of the fitting member 32. It should be noted, however, that when the end portion 56 of hook member 54 is operatively engaged with the notch section 50 of the fitting member 32, it is believed that a linear, point-to-point contact is achieved to obtain a predetermined reactive force vector in opposition to the force vector applied by the vise bar 34, as described hereinabove. The desired linear point-to-point contact between the upwardly projecting member and the notch means is approximately equal to one half of the internal linear distance and is achieved by maintaining an angle $\theta$ between an outside side surface of the vertical flange 44 and an angled side surface 58 of hook member 54.

It should be further noted that when the vise bar 34 exerts downward pressure against the top side surface 38 of the fitting member 32 and outer end 56 of hook 54 exerts an upward linear point-to-point contact against the notch means 50 of fitting 32, the extendibile arms 24 are retracted inwardly to exert horizontal force vectors against the container and thereby assist stabilization thereof during lifting and transporting the working load or the container from one location to another.

It will be understood that various trailer and container manufacturers have several and differing requirements as to dimensions, structural designs and configurations that might necessitate slightly different physical dimensions, in the manufacture of the side fitting 32. Thus, one or more manufacturers of trailers or containers might desire different physical dimensions, for example, in length and thickness of flanges 42 and 44, configuration of notch 50, and the like. Thus, it is the intent of the present invention, however, to include within the ambit of the present invention any and all modifications of side fitting 32 that may be adapted to specific requirements of a manufacturer of trailers and containers.

In the operation of the present invention, the stabilizing beam 18 of the gantry crane apparatus is positioned over and about a truck trailer or a cargo container 20. The grappler system and twist lock systems, generally identified respectively by reference numerals 60 and 62, which are used in conventional lifting and transporting of cargo containers, are moved inwardly toward a central location so as to avoid interference with the latch arm assemblies 26 disposed at the outer ends of the stabilizing beam. The latch arm assemblies 26 are rotated downwardly from a stowed position so as to be located over and about the side corner fittings 32, preferably secured to four upper side locations on the container. The extendible arms 24 are moved outwardly beyond the width of the container and then moved vertically downwardly until a sensor mounting pad 64 contacts the top side of the container and/or the top side of the horizontal flange 42 of side fitting 32 and locates itself thereon in the service position, as shown in FIG. 5. The extendible arms 24 then move inwardly toward the side fittings 32 until an alignment sensor 66 positions the hook member 54 of the latch arm just under the notch means 50 of the side fitting means 32. The vise bar 34 then moves downwardly against the top side surface 38 of the side fitting 32 and simultaneously the outer elongate end 56 of the hook 54 is drawn upwardly into a linear point to point contact with the inner surface of the notch 50 of the side fitting 32. This results in a vertical force pressing downwardly on the top side surface 38 of the side fitting 32 and a like vertical force presses upwardly between the hook 54 of the arm and the notch 50 of the fitting 32 so as to hold the container in vise-like connections at four external locations thereon. Consequently, the crane apparatus is capable of lifting a truck trailer or a cargo container from its top side and placing it on or lifting it off of another container disposed on a railroad freight car.

It will be noted the present invention is especially adaptable for installation on all truck trailer and cargo containers, such as the 48 feet and 53 feet containers currently produced by a number of well known manufacturers. The precise location and installation of the side fittings of the present invention is a matter of choice, but it has been determined that a span of approximately 40 feet between pairs of side fittings is considered satisfactory in accordance with the present invention. The side fittings of the present invention, however, may be adapted to any span length ranging from shorter distances, such as 20 feet and upwardly, so long as appropriate and adequate engineering design criteria are adopted and maintained. Indeed, if the container is of a reduced length, it is within the scope of the present invention that the side fitting members may be located at the corners of the container.

While the present invention has been described with reference to the above preferred embodiments, it will be understood by those skilled in the art, that various changes may be made and equivalence may be substituted for elements thereof without departing from the scope of the present invention. In addition, modifications may be made to adapt a particular situation or material to the teachings of the present invention without departing from the scope of the present invention. Therefore, it is intended that the invention not be limited to the particular embodiments disclosed for carrying out this invention, but that the present invention includes all embodiments falling within the scope of the appended claims.

It will be understood that when the latch box assembly means and the side fitting means are in the engaged position and exerting a vice-like grip on the container, there is obtained an enhanced structural integrity throughout the container and there is also obtained a transfer of moment forces that flow upwardly through the latch box assembly means to the spreader assembly. Thus, it would be possible to lift the container even if there could occur certain structural degradation throughout the roof, walls and floor of the container.

We claim:

1. A side fitting connection assembly comprising, side fitting means mounted to an upper side location on an external surface of a cargo container, said side fitting means including notch means thereon, latch box assembly means secured to and depending from a gantry crane apparatus for engagement with said notch means of said side fitting means, said latch box assembly means including, arm means for horizontal extension outwardly beyond the overall width of said container and movable vertically downwardly along and disposed from an external wall of said container, sensor means for making contact with a top surface of said side fitting means for stopping downward movement of said arm means, means for causing horizontal inward retraction of said arm means, alignment sensor means for stopping said inward retraction of said arm means adjacent said side fitting means, vise bar means movable vertically downwardly to engage a top surface of said fitting means, said side fitting means further including receptacle means for receiving locking means extending downwardly from said latch box assembly means to lift the container, and vertical arm means movable vertically upwardly and having an upwardly projecting member for engagement with said notch means of said fitting means, whereby when said upwardly projecting member of said vertical arm means is engaged with said notch means of said fitting means, a vise-like grip is obtained between said fitting means and said latch box assembly means to permit lifting of the container.

2. A side fitting connection apparatus as claimed in claim 1 wherein said side fitting means is located and positioned at each of the four corners of the cargo container.

3. A side fitting connection apparatus as claimed in claim 1 wherein said upwardly projecting member engages the notch means to provide a linear point-to-point contact therebetween.

4. A side fitting connection apparatus as claimed in claim 3 wherein said linear point-to-point contact between said upwardly projecting member and said notch means is approximately one half of the internal linear dimension of said notch means.

5. A side fitting connection apparatus as claimed in claim 1 wherein said upwardly projecting member is maintained at a predetermined angle to maintain a vertical lifting force on said notch means to permit lifting of the container.

6. A side fitting connection assembly including gantry crane apparatus supporting grappling means for raising and lowering a cargo container from one location to another comprising, side fitting means mounted to an upper side location on an external surface of the cargo container, said side fitting means including a linear notch means and an upper surface thereon, stabilizing beam means secured to and depending from said grappling means for supporting a plurality of latch box assembly means for attachment to said cargo container.

each of said latch box assembly means comprising, extendible arm means for horizontal movement outwardly beyond the overall width of said cargo container and movable vertically downwardly along an external wall of the cargo container, sensor pad means for making contact with said upper surface of said side fitting means for stopping downward movement of said extendible arm means, means for horizontal inward retraction of said extendible arm means, means for stopping said inward retraction of the extendible arm means adjacent said side fitting means, said side fitting means further including receptacle means for receiving locking means extending downwardly from said latch box assembly means to lift the container, and means for moving said extendible arm means vertically to engage said extendible arm means with said linear notch means on said side fittings means to lift the cargo container.

7. A side fitting connection apparatus as claimed in claim 6 wherein said side fitting means is located and positioned at each of the four corners of the cargo container.

8. A side fitting connection apparatus as claimed in claim 6 wherein said extendible arm means engages the notch means to provide a linear point-to point contact therebetween.

9. A side fitting connection apparatus as claimed in claim 8 wherein said linear point-to-point contact between said extendible arm means an said notch means is approximately one half of the internal linear dimension of said notch means.

10. A side fitting connection apparatus as claimed in claim 6 wherein said extendible arm means is maintained at a predetermined angle to maintain a vertical lifting force on said notch means to permit lifting of the container.

11. A method of lifting a cargo container having side fitting means mounted at an upper side surface thereof which provides a notch means thereon, comprising the steps of positioning a latch box assembly means including extendible arm means and arm members with projections thereon secured to and depending from a gantry crane apparatus disposed over the cargo container, extending said extendible arm means downward from the gantry crane apparatus in alignment over said side fitting means on said container, sensing the downward movement of the extendible arm means until engagement with an upper surface of said side fitting means, engaging one of said projections of said arm members with said notch means on said side fitting means, providing receptacle means on said side fitting means for receiving a rotatable locking means extending downwardly from said latch box assembly means to lift the container, and lifting said cargo container for movement from one to another location.

12. The method of claim 11 further including the step of moving said arm members inwardly adjacent said side fitting means.

13. The method of claim 12 further including the step of aligning and sensing the inward movement of said side arm members to stop the inward movement of the side arm member adjacent the side fitting means.

* * * * *